US010920545B2

(12) United States Patent
Wheeler et al.

(10) Patent No.: US 10,920,545 B2
(45) Date of Patent: Feb. 16, 2021

(54) FLOW CONTROL DEVICES IN SW-SAGD

(71) Applicant: CONOCOPHILLIPS COMPANY, Houston, TX (US)

(72) Inventors: Thomas J. Wheeler, Houston, TX (US); David A. Brown, Aurora, TX (US)

(73) Assignee: ConocoPhillips Company, Houston, TX (US)

( * ) Notice: Subject to any disclaimer, the term of this patent is extended or adjusted under 35 U.S.C. 154(b) by 143 days.

(21) Appl. No.: 15/617,034

(22) Filed: Jun. 8, 2017

(65) Prior Publication Data

US 2017/0356275 A1 Dec. 14, 2017

Related U.S. Application Data

(60) Provisional application No. 62/347,806, filed on Jun. 9, 2016.

(51) Int. Cl.

| | |
|---|---|
| ***E21B 43/24*** | (2006.01) |
| ***E21B 43/12*** | (2006.01) |
| ***E21B 43/30*** | (2006.01) |
| ***E21B 34/06*** | (2006.01) |
| *E21B 33/12* | (2006.01) |
| *E21B 34/16* | (2006.01) |

(52) U.S. Cl.

CPC ..... *E21B 43/121* (2013.01); *E21B 34/063* (2013.01); *E21B 43/12* (2013.01); *E21B 43/24* (2013.01); *E21B 43/2406* (2013.01); *E21B 43/305* (2013.01); *E21B 33/12* (2013.01); *E21B 34/16* (2013.01); *E21B 43/123* (2013.01); *E21B 43/126* (2013.01)

(58) Field of Classification Search

CPC ..... E21B 43/2406; E21B 43/2408

See application file for complete search history.

(56) References Cited

U.S. PATENT DOCUMENTS 5,148,869 A * 9/1992 Sanchez ..... E21B 43/305 166/303
5,167,280 A * 12/1992 Sanchez ..... C09K 8/60 166/267
5,215,149 A * 6/1993 Lu ..... E21B 36/00 166/297

(Continued)

OTHER PUBLICATIONS

Falk, K., et al., "Concentric CT for Single-Well Steam Assisted Gravity Drainage", World Oil, Jul. 1996, vol. 217, Issue No. 7, 11 pgs.

(Continued)

*Primary Examiner* — Steven A MacDonald

(74) *Attorney, Agent, or Firm* — Boulware & Valoir

(57) ABSTRACT

A particularly effective well configuration that can be used for single well steam assisted gravity drainage (SW-SAGD) wherein steam flashing through production slots is prevented by including passive inflow control devices (ICDs) or active interval control valves in the completion. A thermal packer separates the injection and production segments of a horizontal well having a toe and a heel, and the ICDs can be evenly spaced or can decrease towards the heel. The cumulative steam to oil ratio (CSOR) of the SW-SAGD well is thus lowered, as compared to the same well without passive flow control devices or active interval control valves.

24 Claims, 8 Drawing Sheets

(56) References Cited

U.S. PATENT DOCUMENTS 5,626,193 A * 5/1997 Nzekwu ..... E21B 43/2406 166/303
5,655,605 A * 8/1997 Matthews ..... E21B 43/121 166/370
5,931,230 A * 8/1999 Lesage ..... E21B 43/24 166/303
6,158,510 A * 12/2000 Bacon ..... E21B 43/088 166/233
7,559,375 B2 7/2009 Dybevik et al.
2008/0251255 A1* 10/2008 Forbes ..... E21B 43/2406 166/305.1
2009/0151950 A1* 6/2009 Patel ..... E21B 41/0035 166/298
2011/0036576 A1* 2/2011 Schultz ..... E21B 36/02 166/303
2011/0094739 A1* 4/2011 Sarathi ..... E21B 43/24 166/272.3
2011/0320047 A1* 12/2011 Stone ..... E21B 43/00 700/282
2012/0043081 A1 2/2012 Kjorholt
2012/0292055 A1* 11/2012 Swist ..... E21B 43/18 166/401
2013/0213652 A1 8/2013 Stalder
2014/0000888 A1* 1/2014 Kerr ..... E21B 43/24 166/272.3
2014/0166278 A1* 6/2014 Kerr ..... E21B 43/2408 166/261
2015/0107842 A1* 4/2015 Sood ..... E21B 43/2406 166/306
2015/0152720 A1* 6/2015 Mogensen ..... E21B 43/2406 166/400
2015/0252657 A1* 9/2015 Dykstra ..... E21B 7/04 166/305.1
2016/0312592 A1* 10/2016 Chen ..... E21B 43/2406

OTHER PUBLICATIONS

Ashok K. et al., "A Mechanistic Study of Single Well Steam Assisted Gravity Drainage", 2000, SPE-59333, Society of Petroleum Engineers. Prepared for the presentation at the 2000 SPE/DOE Improved Oil Recovery Symposium held in Tusla, OK Apr. 3-5, 2000, pp. 1-24; 24 pgs.

Elliot, K., et al, "Simulation of early-time response of singlewell steam assisted gravity drainage (SW-SAGD)", 1999, SPE-54618, Society of Petroleum Engineers, Prepared for the presentation at the 1999 SPE Western Regional Meeting held in Anchorage, Alaska May 26-28, 1999, pp. 1-12; 12 pgs.

Stalder, John L., "Test of SAGD Flow Distribution Control Liner System, Surmont Field, Alberta, Canada", 2012, SPE-153706, Society of Petroleum Engineers, SPE International. Prepared for the presentation at the SPE Western Regional Meeting held in Bakersfield, CA, Mar. 19-23, 2012, pp. 1-9; 9 pgs.

Shin, H., et al—"Fast-SAGD Application in the Alberta Oil Sands Areas", 2005, University of Alberta, Journal of Canadian Petroleum Technology, pp. 46-53; 8 pgs.

* cited by examiner

SWSAGD UPDIP WELL

FLOW CONTROL DEVICES IN SW-SAGD

PRIORITY CLAIM

This application is a non-provisional application which claims benefit under 35 U.S.C. § 119(e) to U.S. Provisional Application Ser. No. 62/347,806 filed Jun. 9, 2016, entitled "FLOW CONTROL DEVICES IN SW-SAGD," which is incorporated herein in its entirety.

FEDERALLY SPONSORED RESEARCH STATEMENT

Not Applicable.

FIELD OF THE DISCLOSURE

This disclosure relates generally to well configurations that can advantageously produce oil using steam-based mobilizing techniques. In particular, it relates to single well gravity drainage techniques wherein steam breakthrough is prevented using strategically placed inflow control devices.

BACKGROUND OF THE DISCLOSURE

Many countries in the world have large deposits of oil sands, including the United States, Russia, and the Middle East, but the world's largest deposits occur in Canada and Venezuela. Oil sands are a type of unconventional petroleum deposit, containing naturally occurring mixtures of sand, clay, water, and a dense and extremely viscous form of petroleum technically referred to as "bitumen," but which may also be called heavy oil or tar. Bitumen is so heavy and viscous (thick) that it will not flow unless heated or diluted with lighter hydrocarbons. At room temperature, bitumen is much like cold molasses, and the viscosity can be in excess of 1,000,000 cP.

Due to their high viscosity, these heavy oils are hard to mobilize, and they generally must be heated in order to produce and transport them. One common way to heat bitumen is by injecting steam into the reservoir. Steam Assisted Gravity Drainage or "SAGD" is the most extensively used technique for in situ recovery of bitumen resources in the McMurray Formation in the Alberta Oil Sands.

In a typical SAGD process, two horizontal wells are vertically spaced by 4 to 10 meters (m). See FIG. 1. The production well is located near the bottom of the pay and the steam injection well is located directly above and parallel to the production well. Steam is injected continuously into the injection well, where it rises in the reservoir and forms a steam chamber. With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within steam chamber.

The use of gravity gives SAGD an advantage over conventional steam injection methods. SAGD employs gravity as the driving force and the heated oil remains warm and movable when flowing toward the production well. In contrast, conventional steam injection displaces oil to a cold area, where its viscosity increases and the oil mobility is again reduced.

Although quite successful, SAGD does require large amounts of water in order to generate a barrel of oil. Some estimates provide that 1 barrel of oil from the Athabasca oil sands requires on average 2 to 3 barrels of water, and it can be much higher, although with recycling the total amount can be reduced. In addition to using a precious resource, additional costs are added to convert those barrels of water to high quality steam for down-hole injection. Therefore, any technology that can reduce water or steam consumption has the potential to have significant positive environmental and cost impacts.

Additionally, SAGD is less useful in thin stacked payzones, because thin layers of impermeable rock in the reservoir can block the expansion of the steam chamber leaving only thin zones accessible, thus leaving the oil in other layers behind. Further, the wells need a vertical separation of about 5 meters in order to maintain the steam trap. In wells that are closer, live steam can break through to the producer well, resulting in enlarged slots that permit significant sand entry, well shutdown and damage to equipment.

Indeed, in a paper by Shin & Polikar (2005), the authors simulated reservoir conditions to determine which reservoirs could be economically exploited. The simulation results showed that for Cold Lake-type reservoirs, a net pay thickness of at least 20 meters was required for an economic SAGD implementation. A net pay thickness of 15 m was still economic for the shallow Athabasca-type reservoirs because of the high permeability of this type of reservoir, despite the very high bitumen viscosity at reservoir conditions. In Peace River-type reservoirs, net pay thicker than 30 meters was expected to be required for a successful SAGD performance due to the low permeability of this type of reservoir. The results of the study indicate that the shallow Athabasca-type reservoir, which is thick with high permeability (high k×h), is a good candidate for SAGD application, whereas Cold Lake and Peace River-type reservoirs, which are thin with low permeability, are not as good candidates for conventional SAGD implementation.

In order to address the thin payzone issue, some petroleum engineers have proposed a single wellbore steam assisted gravity drainage or "SW-SAGD." See e.g., FIG. 2A. In SW-SAGD, a horizontal well is completed and assumes the role of both injector and producer. In a typical case, steam is injected at the toe of the well, while hot reservoir fluids are produced at the heel of the well, and a thermal packer is used to isolate steam injection from fluid production (FIG. 2A).

Another version of SW-SAGD uses no packers, simply tubing to segregate flow. Steam is injected at the end of the horizontal well (toe) through an isolated concentric coiled tubing (ICCT) with numerous orifices. In FIG. 2B a portion of the injected steam and the condensed hot water returns through the annular to the well's vertical section (heel). The remaining steam, grows vertically, forming a chamber that expands toward the heel, heating the oil, lowering its viscosity and draining it down the well's annular by gravity, where it is pumped up to the surface through a second tubing string.

Advantages of SW-SAGD might include cost savings in drilling and completion and utility in relatively thin reservoirs where it is not possible to drill two vertically spaced horizontal wells. Basically since there is only one well, instead of a well pair, start up costs are only half that of conventional SAGD. However, the process is technically challenging and the method seems to require even more steam than conventional SAGD.

Field tests of SW-SAGD are not extensively documented in the literature. Falk overviewed the completion strategy and some typical results for a project in the Cactus Lake Field, Alberta Canada. A roughly 850 m long well was installed in a region with 12 to 16 m of net pay to produce 12° API gravity oil. The reservoir contained clean, unconsolidated, sand with 3400 and permeability. Apparently, no attempts were made to preheat the reservoir before initiation of SW-SAGD. Steam was injected at the toe of the well and oil produced at the heel. Oil production response to steam was slow, but gradually increased to more than 100 $m^3$/d. The cumulative steam-oil ratio was between 1 and 1.5 for the roughly 6 months of reported data.

McCormack also described operating experience with nineteen SW-SAGD installations. Performance for approximately two years of production was mixed. Of their seven pilot projects, five were either suspended or converted to other production techniques because of poor production. Positive results were seen in fields with relatively high reservoir pressure, relatively low oil viscosity, significant primary production by heavy-oil solution gas drive, and/or insignificant bottom-water drive. Poor results were seen in fields with high initial oil viscosity, strong bottom-water drive, and/or sand production problems. Although the authors noted that the production mechanism was not clearly understood, they suspected that the mechanism was a mixture of gravity drainage, increased primary recovery because of near-wellbore heating via conduction, and hot water induced drive/drainage.

Ashok (2000) observed that the use of the same well for injection and production involved a significant risk that a portion of the steam returning through the well without entering the reservoir would close itself off in a short circuit. According to some, this is due to the fact of the capillary pressure prevents steam flow into the rock, causing the oil recovery to be very low. The authors also verified that the temperature distribution inside the reservoir is not uniform and the heated area around the well varies considerably along the length of the well. In the heated area, the pressure gradient along the well caused a partial movement of oil towards the heel of the well and it significantly influenced the amount of steam that entered the formation and the amount of oil and condensed water that were produced in the producing well. Indeed, some steam always returns along the well without entering the reservoir, deviating into a short circuit.

One potential solution to the steam cycling problem at the toe was identified by Kerr (US20140000888). His idea requires the operator to turn the toe of the well upward and limit the length of the injection area at the toe. Thus, any steam cycling will typically be restricted to the toe area since steam will have a tendency to rise, and thus remain above the production slots, reducing breakthrough. However, this method is not always practical, particularly in very thin payzones or payzones without a convenient updip for locating the upturned toe. Further, it doesn't prevent steam breakthrough as the steam chamber grows towards the heel.

Therefore, although beneficial, the SW-SAGD methodology could be further developed to improve its cost effectiveness.

SUMMARY OF THE DISCLOSURE

One issue with any type of completion in a steam recovery process is steam flashing at the slots, which may result in the slots expanding and hence increasing sand production and the concomitant damage. In SW-SAGD in particular, steam has a tendency to cycle at the toe once a steam chamber is initiated at the toe (FIG. 3), thus flashing to the nearby production slots.

We suggest that a better solution is to employ passive or active flow control devices in completion of the SW-SAGD horizontal well. The passive inflow control devices or "ICDs" use a pressure drop to slow steam and gas flow. Stalder (US20130213652; SPE-153706), for example, discusses the improved "steam-trap" control that is introduced when ICDs are used in the completion. These devices provide better equalization, control steam trap, hence liquid height above the producer, and limit and/or prevent live steam from entering the producer.

There are many commercially available passive ICDs for SAGD that can be used in SW-SAGD. In one embodiment, a mechanical flow control device may be selected from a rate sensitive flow restrictor, a rate sensitive flow valve, or an orifice device, Halliburton's EQUIFLOW™ ICD, Baker Oil Tools EQUILIZER™ ICD, Schlumberger's RESFLOW™ ICD, and the like.

There are also "active inflow control valves" or "ICVs" (with surface actuation) that could be used in the invention as well. An example would be Halliburton's thermal ICV system installed at Shell's Orion Project. In one embodiment, the ICV may be controlled electronically or hydraulically by temperature, density, hydrocarbon content, or other measurable property of the fluid.

Packers, isolation systems such as a polished bore receptacle (PBR), and flow control devices provide a system for selectively isolating production zones for treatment with steam and for controlling the flow of the produced hydrocarbons. Many flow control devices are already commercially available for SAGD. Baker Oil EQUALIZER™ Tool technology has used a liner system to control gas and water coning in conventional oil and gas operations since 1998.

Dybevik, et al., U.S. Pat. No. 7,559,375, for example, discloses an inflow control device for choking pressures in fluids flowing radially into a drainage pipe of a well. Such devices will significantly increase the cost of completions. Our modeling studies show, however, that the cost will be more than recovered over time as the CSOR is significantly reduced by preventing steam from flashing through.

The method is otherwise similar to SAGD, which required steam injection (in both wells) to establish fluid communication (not needed here) between wells as well as to develop a steam chamber. When the steam chamber is well developed, injection proceeds in only the injectors, and production begins at the producer.

Preferably, the method includes preheat cyclic steam phases, wherein steam is injected throughout both injector and producer segment, for e.g. 20-50 days, then allowed to soak into the reservoir, e.g., for 10-30 days, and this preheat phase is repeated two or preferably three times. This ensures adequate steam chamber growth along the length of the well.

In one embodiment, the steam injection may be combined with solvent injection or non-condensable gas injection, such as $CO_2$, as solvent dilution and gas lift can assist in recovery.

The invention can comprise any one or more of the following embodiments, in any combination(s) thereof:

A method of producing heavy oils from a reservoir by single well stream and gravity drainage (SW-SAGD), comprising:

providing a horizontal well below a surface of a reservoir;

said horizontal well having a toe end and a heel end and having at least two segments separated by a packer:

a production segment at said heel end fitted for production, and an injection segment at said toe end fitted for steam injection;

said horizontal well fitted with a plurality of flow control devices ("FCDs"), said FCDs being a passive inflow control device ("ICD") or an active internal control valve ("ICV");

injecting steam into said injection segment to mobilize heavy oil; and simultaneously producing mobilized heavy oil at said production segment;

wherein said method has a lower cumulative steam to oil ration than the same reservoir developed using a SW-SAGD well without said plurality of FCDs.

An improved method of producing heavy oils from a SW-SAGD, wherein steam in injected into a toe end of a horizontal well to mobilize oil which is then produced at a heel end of said horizontal well, the improvement comprising providing a plurality of ICDs in the horizontal well, thus improving a CSOR of said horizontal well. as compared to the same well without said plurality of ICDs.

An improved method of producing heavy oils from a SW-SAGD, wherein steam in injected into a toe end of a horizontal well to mobilize oil which is then produced at a heel end of said horizontal well, the improvement comprising providing a plurality of passive ICDs or active ICVs in the horizontal well, thus improving a CSOR of said horizontal well. as compared to the same well without said plurality of passive ICDs or active ICVs.

A well configuration for producing heavy oils from a reservoir by single well steam and gravity drainage (SW-SAGD), comprising: a horizontal well below a surface of a reservoir;

said horizontal well having a toe end and a heel end and having at least two segments separated by a packer:

a production segment at said heel end fitted for production, and an injection segment at said toe end fitted for steam injection;

said horizontal well fitted with a plurality of passive inflow control devices (ICDs).

A method or well configuration as herein described, wherein a thermal packer separates said injection segment and said production segment.

A method or well configuration as herein described, wherein said plurality of FCDs are evenly spaced along the entire well.

A method or well configuration as herein described, wherein said plurality of FCDs are evenly placed through said second segment and a spacing between FCDs increases towards said heel.

A method or well configuration as herein described, wherein said FCDs are passive ICDs.

A method or well configuration as herein described, wherein said FCDs are active ICVs that can be controlled from said surface.

A method or well configuration as herein described, wherein said injection segment extends upwardly into said reservoir and is above said production segment.

A method or well configuration as herein described, wherein injected steam includes solvent.

A method or well configuration as herein described, wherein at least one blank pipe section is laced between said injection segment and said production segment.

A method or well configuration as herein described, wherein a more restrictive ICD in the injection segment than in the production segment of the well.

A method or well configuration as herein described, wherein a thermal packer is placed in said blank pipe to separate said injection segment and said production segment.

A method as herein described, wherein said method includes a pre-heating phase comprising a steam injection period followed by a soaking period. Preferably two or three cyclic preheating phases are used with soak periods therebetween or e.g., 10-30 or 20 days.

A method as herein described, wherein said method includes a pre-heating phase comprising a steam injection in both the injection segment and the production segment followed b a soaking period.

A method or well configuration as herein described, wherein said blank pipe is 12-24 meters.

A method or well configuration as herein described, wherein said production segment is 300-600 meters, said blank pipe is 12-50 meters, and said injection segment is 150-250 meters.

"SW-SAGD" as used herein means that a single well serves both injection and production purposes, but nonetheless there may be an array of SW-SAGD wells to effectively cover a given reservoir. This is in contrast to conventional SAGD where the injection and production wells are separate, necessitating a wellpair at each location.

"Flow control devices" or "FCDs" include both active and passive flow control devices. Although some use FCDs in a much broader sense to include any kind of flow control device, including simple plugs, the term is not used so broadly herein.

By "inflow control devices" or "ICDs" (also known as "passive ICDS" or "PICDs") what is meant is a passive well completion device that restricts the fluid flow from the annulus into the base pipe by virtue of creating a pressure drop. The restriction can be in form of channels (FIG. 7A) or nozzles/orifices (FIG. 7B) or combinations thereof, but in any case the ability of an ICD to equalize the inflow along the well length is due to the difference in the physical laws governing fluid flow in the reservoir and through the ICD. By restraining, or normalizing, flow through high-rate sections, ICDs create higher drawdown pressures and thus higher flow rates along the bore-hole sections that are more resistant to flow. This corrects uneven flow caused by the heel-toe effect and heterogeneous permeability.

An "inflow control valve," also known as an "interval control valve" or "ICV" is a remote controlled active valve that allows user control over interval access and/or can be used to prevent steam breakthrough. At the high end of the scale are electrically controlled continuously variable ICVs with pressure and temperature measurements and valve position feedback at each valve. The typical cost of such a valve is in the order of $0.5 million. Less expensive solutions employ valves that have a limited number of discrete valve opening settings, or can just switch between open and closed (on/off valves). In addition to electrically powered system, hydraulic systems are available.

By "providing" a well, we mean to drill a well or use an existing well. The term does not necessarily imply contemporaneous drilling because an existing well can be retrofitted for use, or used as is.

By being "fitted" for injection or production what we mean is that the completion has everything it needs in terms of equipment needed for injection or production.

"Vertical" drilling is the traditional type of drilling in oil and gas drilling industry, and includes any well <45° of vertical.

"Horizontal" drilling is the same as vertical drilling until the "kickoff point" which is located just above the target oil or gas reservoir (pay-zone), from that point deviating the drilling direction from the vertical to horizontal. By "horizontal" what is included is an angle within 45° (<45°) of horizontal. Additionally, the horizontal well need not be entirely horizontal. Typically the "horizontal" well follows the reservoir and is aligned with the layer or layers of producing reservoir. In another embodiment the toe and/or heel of the "horizontal" well may deviate from the rest of the well to create directional flow in the well toward the heel. In one embodiment the entire "horizontal" portion of the well is angled to assist gravitational flow along the well. In another embodiment the "horizontal" portion of the well may undulate up and down to create lower and higher points along the horizontal well. Of course every horizontal well has a vertical portion to reach the surface, but this is conventional, understood, and typically not discussed.

A "joint" is a single section of pipe.

By "slotted" pipe or tubular what is meant is a joint fitted with slots for production or injection uses. A "perforated" pipe is similar, the perforations are typically round, instead of long and narrowed as in a slotted pipe. Every, slotted or perforated joint includes end sections that are not slotted or perforated, but this is conventional, understood, and typically not discussed.

A "blank" pipe is a joint that lacks any holes or perforations along the entire length of the pipe section.

"Casing" refers to large diameter pipe that is assembled and inserted into a recently drilled section of a borehole and typically held into place with cement. The size of the casing refers to the outside diameter (O.D.) of the main body of the tubular (not the connector). Casing sizes vary from 4.5" to 36" diameter. Tubulars with an O.D. of less than 4.5" are called "tubing."

API standards recognize three length ranges for casing, although frequently casing is provided in 40 ft (12 m) lengths:

Range 1 (R-1): 16-25 ft

Range 2 (R-2): 25-34 ft

Range 3 (R-3): >34 ft

A "liner" is a casing string that does not extend to the top of the wellbore, but instead is anchored or suspended from inside the bottom of the previous casing string. There is no difference between the casing joints themselves. Many conventional well designs include a production liner set across the reservoir interval. This reduces the cost of completing the well and allows some flexibility in the design of the completion in the upper wellbore.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| bbl | Oil barrel, bbls is plural |
| CSOR | Cumulative Steam to oil ratio |
| CSS | Cyclic steam stimulation |
| ES-SAGD | Expanding solvent-SAGD |
| FCD | Flow control device, include active and passive flow control devices |
| FRR | Flow resistance rating - a measure of the strength of an ICD |
| ICD | Inflow control device (aka PICD or passive ICD) |
| OCD | Outflow control device |
| OOIP | Original Oil in Place |
| SAGD | Steam assisted gravity Drainage |
| SD | Steam drive |
| SOR | Steam to oil ratio |

DESCRIPTION OF EMBODIMENTS

Figure 1A:
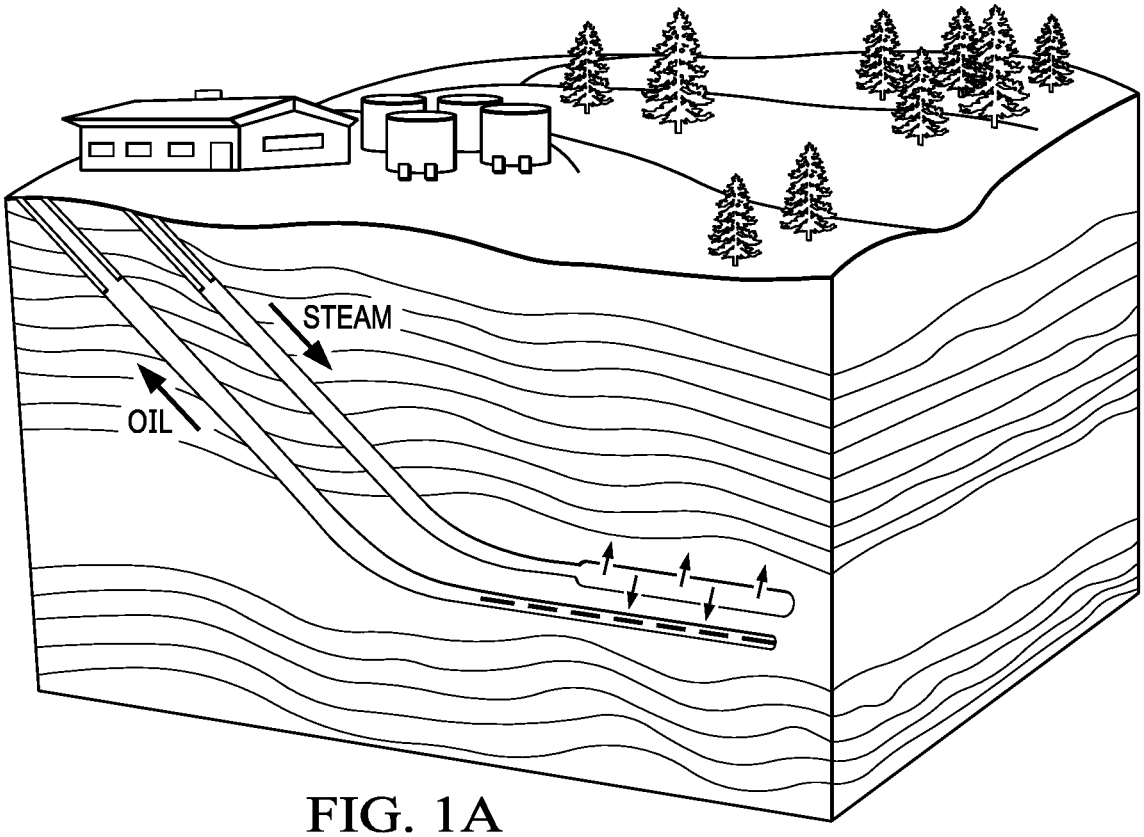
FIG. 1A (PRIOR ART)
FIG. 1A shows traditional SAGD wellpair, with injector well a few meters above a producer well.
Figure 1B:
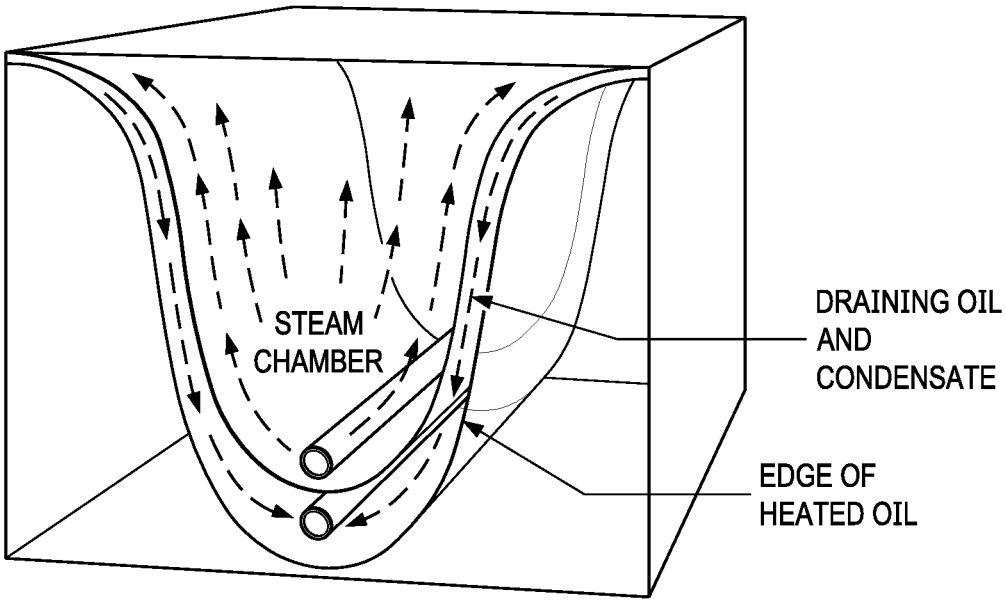
FIG. 1B (PRIOR ART)
FIG. 1B shows a typical steam chamber.
Figure 2A:
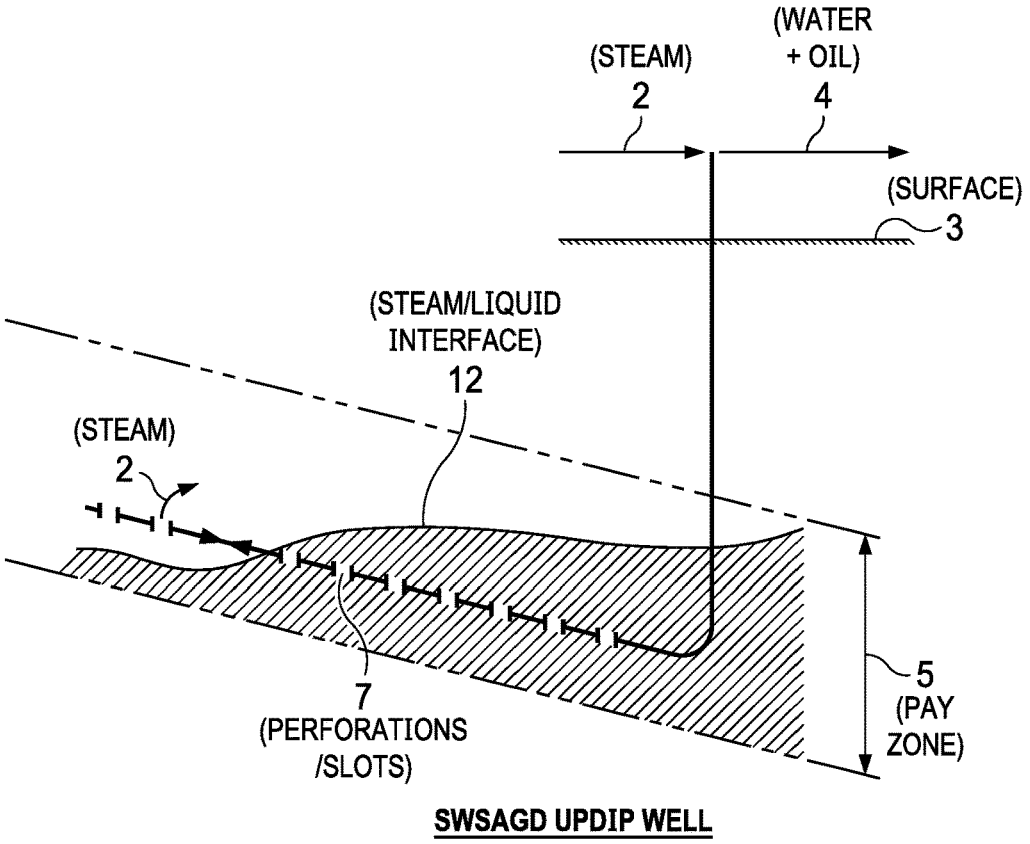
FIG. 2A (PRIOR ART)
FIG. 2A shows a SW-SAGD well, wherein the same well functions for both steam injection and oil production. Steam is injected into the toe (in this case the toe is updip of the heel), and the steam chamber grows towards the heel.
Figure 2B:
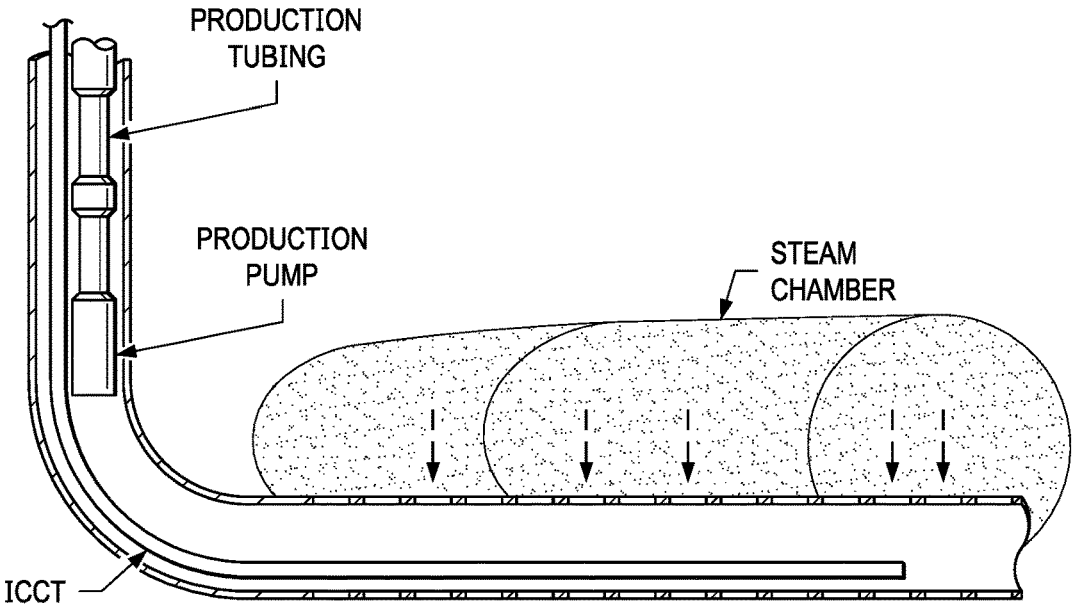
FIG. 2B (PRIOR ART)
FIG. 2B shows another SW-SAGD well configuration wherein steam is injected via CT, and a second tubing is provided for hydrocarbon removal.
Figure 3:
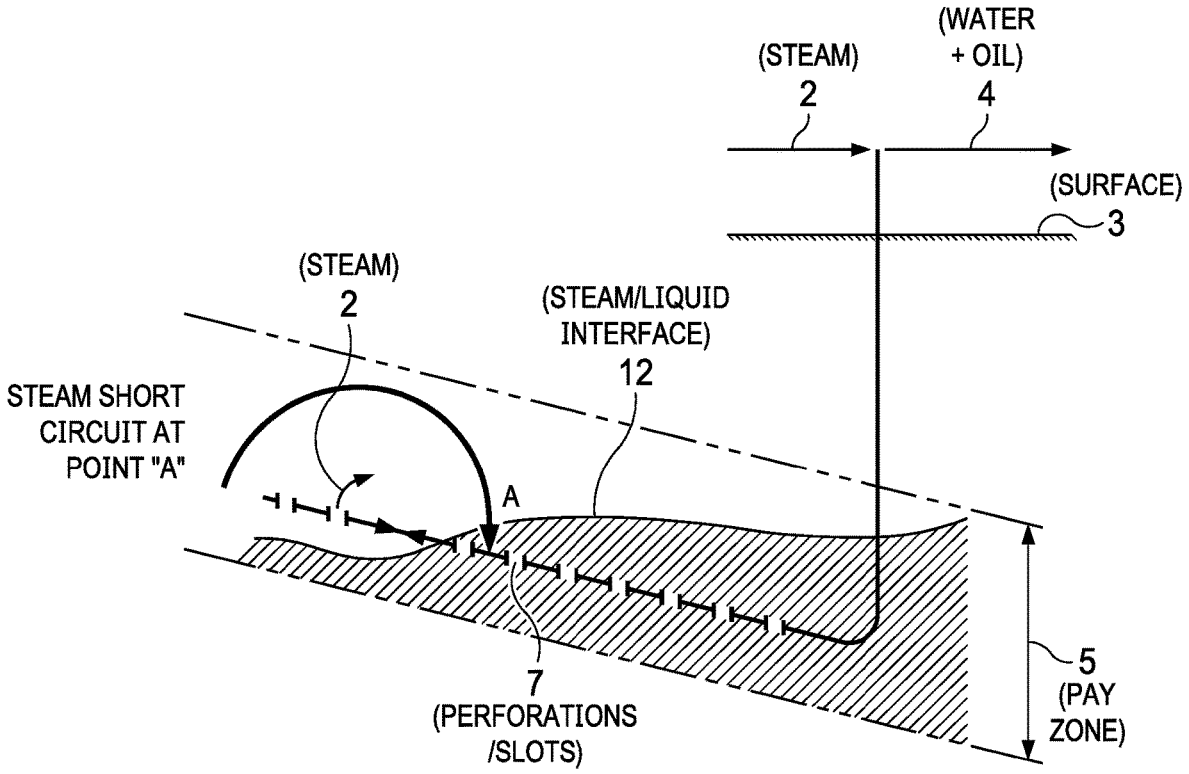
FIG. 3 shows steam cycling at the toe, thus breaking through to the production slots.

The present disclosure provides a novel well configurations and method for SW-SAGD, wherein passive or active inflow control devices are used together with packers prevent steam break through.

ICDs are placed at the end of the producer nearest the injector, thus reducing the problem of steam cycling at the toe. However, ICDs can also be placed in the injector portion, thus preventing steam loss even at the toe. Further, if flow control along the producer length is needed, e.g., due to uneven steam chamber development, it is advantageous to place ICDs along the length of the producer.

Use of ICDs all along the well serves to minimize breakthrough along its entire length, which is particularly beneficial in SW-SAGD since there is no vertical separation between steam injection and production. Thus, this placement is generally preferred.

Spacing of ICD's may be dictated by reservoir heterogeneity. However, it may also be possible to decrease the spacing of the ICDs towards the heel section, as steam chamber growth tends to be less pronounced at the heel. An ideal spacing may be one device per joint, but more or less can be used, depending on reservoir conditions, and density can be easily varied by varying joint length or by using an ICD every other joint and combinations thereof. Simulations are typically be used to evaluate optimal spacing under reservoir conditions.

It is also possible to vary the strength of an ICD along the well length. Typically, a more restrictive ICD will be used in the injection section (for instance a 0.4 FRR (Flow Resistance Rating) versus a 1.6 FRR in the production part of the well. Combinations of strength and spacing may also be advantageously employed to control flow along the length of the well.

ICDs are usually pre-configured on surface and after the deployment, it is not possible to adjust the chokes to alter the flow profile into the well unless a work over is performed where the completion is withdrawn from the well and replaced. When used in a steam injection well, ICDs are able to make more evenly distributed steam injection along the well bore. When used in a SW-SAGD production well, ICDs are able to balance the flow profile along the well and to balance well bore pressure; thus to prevent steam breakthrough and help to achieve steam trap control. They are very beneficial in SW-SAGD where steam breakthrough near the toe presents particular challenges, and where breakthrough all along the well is more prevalent than in conventional SAGD where the steam is injected above the producer. An ICV can be used anywhere an ICD is used, but ICDs may be preferred in some instances as less expensive.

Stalder investigated the flow distribution control of passive ICDs. Based on the observation of an ICD-deployed SAGD well pair in a Surmont SAGD operation, he came to the conclusion that an ICD-deployed single tubing completion achieved similar or better steam conformance as compared to the standard toe/heel tubing injection. In addition, the ICD completion significantly reduced tubing size which in turn reduced the size of slotted liner, intermediate casing, and surface casing. The smaller wellbore size increases directional drilling flexibility and reduced drag making it easier and lower cost to drill the wells. Thus, wells can be drilled much longer than current SAGD wells, which tend to be between 500 and 1000 m.

ICD Completions

SW-SAGD wells not only bring advantages, but also present new challenges in terms of drilling, completion and production. One of these challenges is the frictional pressure losses increasing with well length. The inflow profile becomes distorted so that the heel part of the well produces more fluid than the toe when these losses become comparable to drawdown. This inflow imbalance, in turn, often causes premature water or gas breakthrough, which should be avoided.

Installation of ICDs or ICVs is an advanced well completion option that provides a practical solution to this challenge. An ICD is a well completion device that directs the fluid flow from the annulus into the base pipe via a flow restriction and an ICV is a remote controlled valve.

The ability of an ICD to equalize the inflow along the well length is due to the difference in the physical laws governing fluid flow in the reservoir and through the ICD. Liquid flow in porous media is normally laminar, hence there is a linear relationship between the flow velocity and the pressure drop. By contrast, the flow regime through an ICD is turbulent, resulting in a quadratic velocity/pressure drop relationship.

The physical laws of flow through an ICD make it especially effective in reducing the free gas production. In situ gas viscosity under typical reservoir conditions is normally at least an order of magnitude lower than that of oil or water; while in situ gas density is only several times smaller than that of oil or water. Gas inflow into a well will thus dominate after the initial gas breakthrough if it is not restricted by gravity or an advanced completion. ICDs introduce an extra pressure drop that is proportional to the square of the volumetric flow rate. The dependence of this pressure drop on fluid viscosity is weak for channel devices and totally absent if nozzle or orifice ICDs are used. These characteristics enable ICDs to effectively reduce high velocity gas inflow.

The magnitude of a particular ICD's resistance to flow depends on the dimensions of the installed nozzles or channels. This resistance is often referred to as the ICD's "strength". It is set at the time of installation and cannot be changed without a major intervention to recomplete the well.

ICDs have been installed in hundreds of wells during the last decade, being now considered to be a mature, well completion technology. Steady-state performance of ICDs can be analyzed in detail with well modeling software. Most reservoir simulators include basic functionality for ICD modeling.

Figure 4:
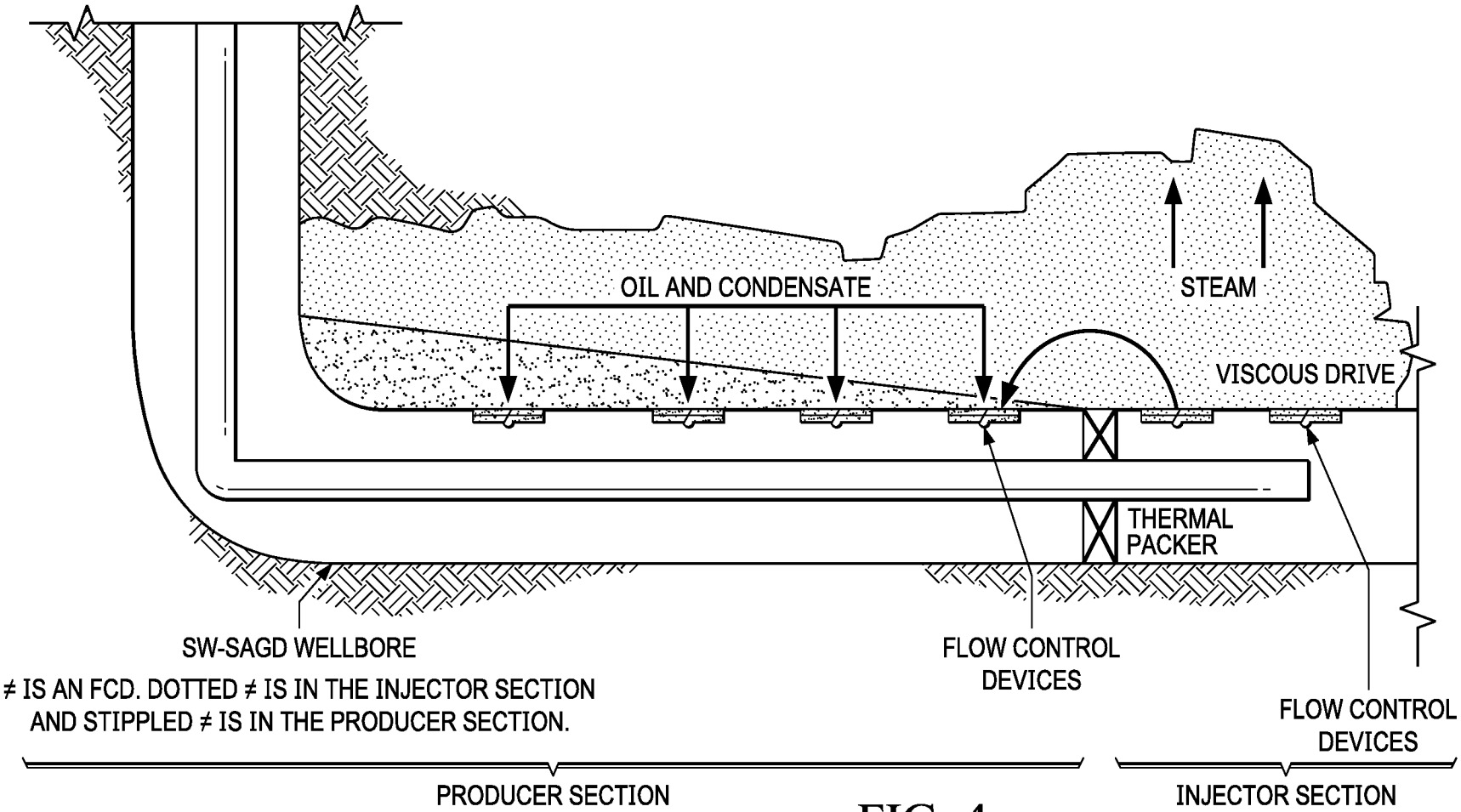
FIG. 4 show one embodiment of the invention wherein SW-SAGD is performed using passive ICDs.

FIG. 4 shows an exemplary completion using a single well with injector and producer portions separated by thermal packers. Steam breakthrough is prevented with ICDs, especially near the injector producer changeover, thus wasting less steam and more quickly developing the steam chamber.

Figure 5:
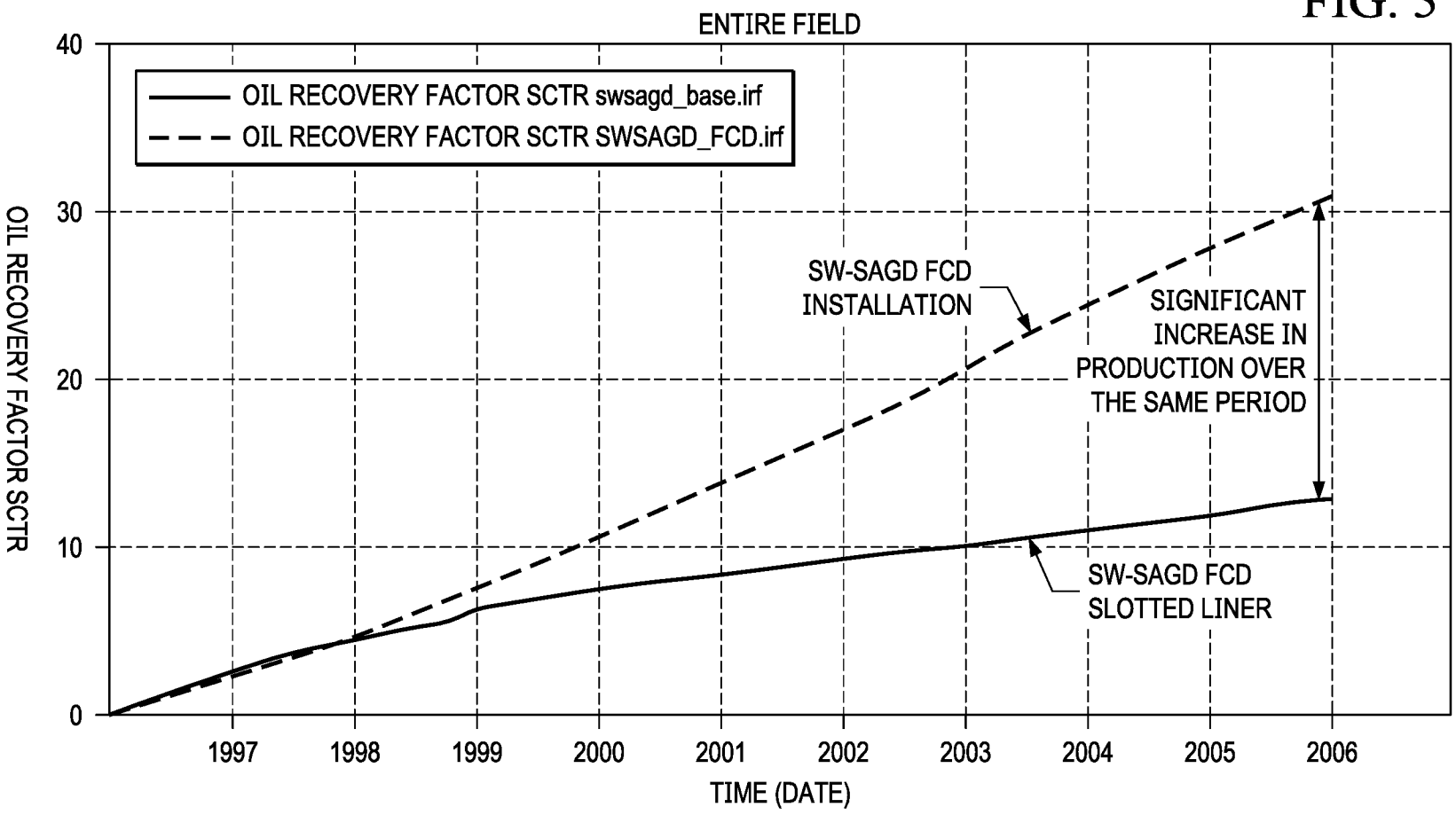
FIG. 5 shows a comparison of the SW-SAGD cumulative oil recovery of convention SW-SAGD using thermal packers, versus SW-SAGD with passive ICDs. The graph indicates a significant increase in production over a nine year simulation. Computer Modeling Groups' (CMG) STARS thermal simulator was used to perform the analysis.
Figure 6:
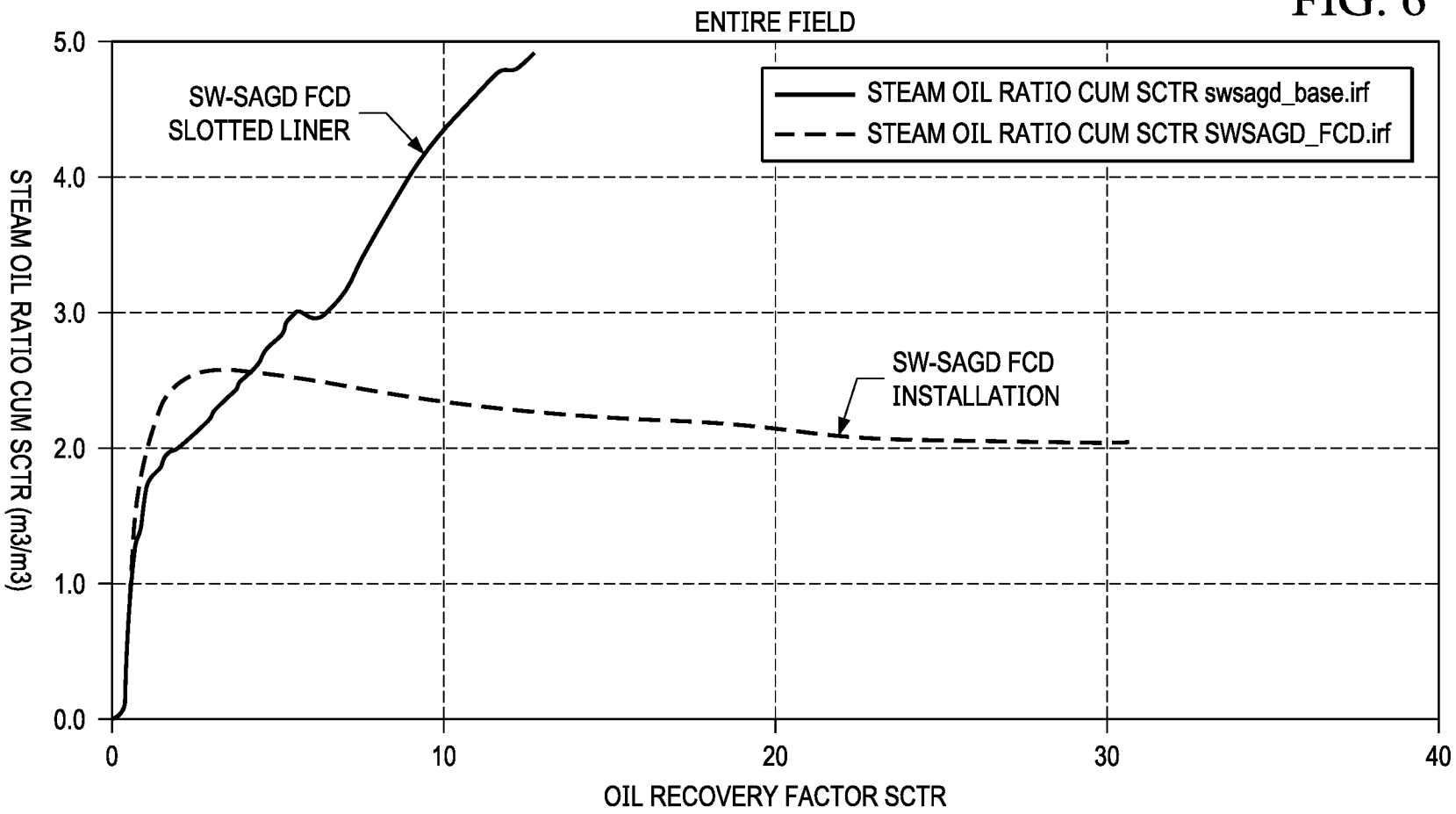
FIG. 6 shows a comparison of the CSOR for conventional SW-SAGD using thermal packers, versus SW-SAGD with passive ICDs and packers. As can be seen, the prior art method uses considerable more steam. Computer Modeling Groups' (CMG) STARS thermal simulator was used to perform the modeling.
Figure 7A:
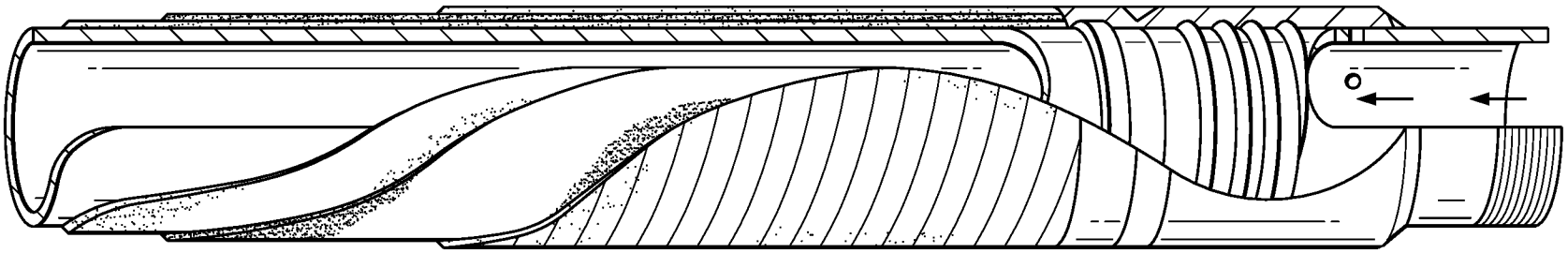
FIG. 7A shows a channel type passive ICD.
Figure 7B:
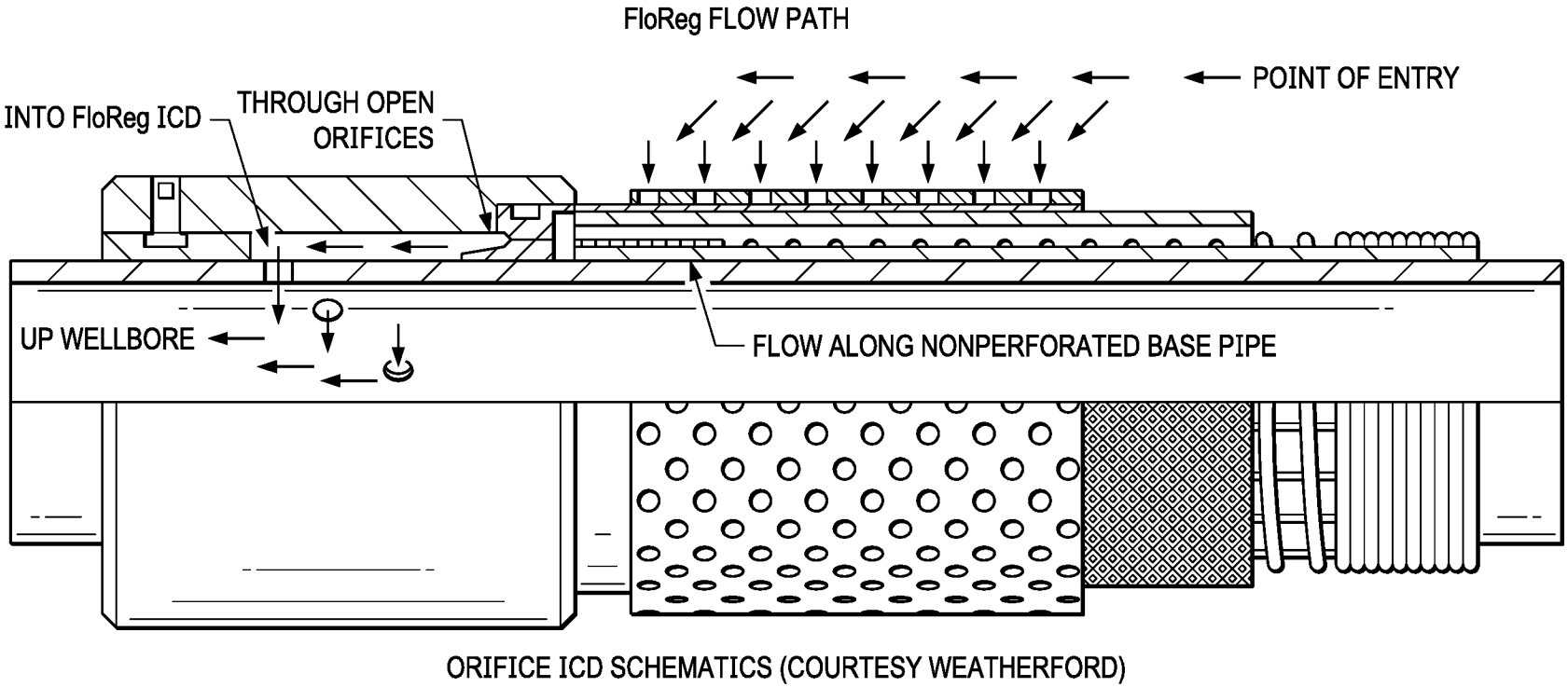
FIG. 7B shows a nozzle type passive ICD.

FIGS. 5 and 6 show simulation results of a simulated McMurray reservoir using CMS-Stars wherein 200 meters of injector was fitted with 4 ICDs and 800 m of producer was fitted with 20 ICDs and a thermal packer was placed between the two sections. The ICDs were fitted at a spacing of one per joint (~40 feet), and the tubulars were blank between each ICD. At the injector segment, we had 6 inches of sand screen on about 2% of the well. The producer included 17 ft of screen on each joint. In this case a ICD was modeled based upon the Baker Equalizer, which is a channel type ICD, as shown in FIG. 7A. However, a nozzle type ICD (7B) a combination types are expected to have similar performance improvements. The simulations used porosity=33%, Perm Horizontal=3400 md, Perm Vertical was 680 md, Chamber Pressure=5500 kPa Max and a Wellbore Sub-Cool of 5° C.

As can be seen, cumulative oil recovery increased with time as compared to the same well lacking the ICDs and the CSOR was significantly reduced. The spike in the CSOR in the conventional SW-SAGD is due to steam loss by breakthrough to the producer, which can be prevented or at least minimized with passive ICDs (FIG. 6). Preventing this steam breakthrough improves the thermal efficiency of the process, keeping heat in the reservoir.

Temperature profiling was also done (not shown), and over time a more even chamber was formed using the ICDs with 3× cyclic steam preheat.

The following references are incorporated by reference in their entirety for all purposes.

Falk, K., et al., Concentric CT for Single-Well Steam Assisted Gravity Drainage, World Oil, July 1996, pp. 85-95.

McCormack, M., et al., Review of Single-Well SAGD Field Operating Experience, Canadian Petroleum Society Publication, No. 97-191, 1997.

SPE-59333 (2000) Ashok K. et al., A Mechanistic Study of Single Well Steam Assisted Gravity Drainage.

SPE-54618 (1999) Elliot, K., Simulation of early-time response of singlewell steam assisted gravity drainage (SW-SAGD).

SPE-153706 (2012) Stalder, Test of SAGD Flow Distribution Control Liner System, Surmont Field, Alberta, Canada US20120043081 Single well steam assisted gravity drainage US20130213652 SAGD Steam Trap Control US20140000888 Uplifted single well steam assisted gravity drainage system and process

The invention claimed is:

1. A method of producing heavy oils from a reservoir by single well steam and gravity drainage ("SW-SAGD"), comprising:

a) providing a single horizontal well having a length in a heavy oil reservoir, the entire length of said horizontal well consisting essentially of blank tubulars and a plurality of flow control devices ("FCDs"), each said FCD between blank tubulars;

b) said horizontal well having a production segment at a heel end fitted for production, and an injection segment at a toe end fitted for steam injection, with no vertical separation between said production segment and said injection segment, wherein said plurality of FCDs are more restrictive with a lower flow resistance rating in said injection segment than in said production segment;

c) injecting steam into said injection segment to mobilize heavy oil and simultaneously producing mobilized heavy oil at said production segment;

d) wherein said method has a lower cumulative steam to oil ratio (CSOR) than said reservoir developed using a similar SW-SAGD well but with slots instead of said plurality of FCDs.

2. The method of claim 1, wherein a thermal packer separates said injection segment and said production segment.

3. The method of claim 1, wherein said FCDs are passive inflow control devices ("ICDs").

4. The method of claim 1, wherein said FCDs are active interval control valves ("ICVs") that can be controlled from said surface.

5. The method of claim 1, wherein injected steam includes a solvent.

6. The method of claim 1, wherein at least one blank pipe section is placed between said injection segment and said production segment.

7. The method of claim 6, wherein a thermal packer is placed in said blank pipe to separate said injection segment and said production segment.

8. The method of claim 7, wherein said blank pipe is 12-24 meters.

9. The method of claim 7, wherein said production segment is 300-600 meters, said blank pipe is 12-50 meters, and said injection segment is 150-250 meters.

10. The method of claim 1, wherein said method includes a pre-heating phase comprising a steam injection period followed by a soaking period.

11. The method of claim 10, including two cyclic pre-heating phases.

12. The method of claim 10, including three cyclic pre-heating phases.

13. The method of claim 10, wherein said soaking period is 10-30 days.

14. The method of claim 10, wherein said soaking period is 20 days.

15. The method of claim 1, wherein said method includes a pre-heating phase comprising a steam injection in both the injection segment and the production segment followed by a soaking period.

16. The method of claim 15, including two cyclic pre-heating phases.

17. The method of claim 15, including three cyclic pre-heating phases.

18. A well configuration for producing heavy oils from a reservoir by single well steam and gravity drainage ("SW-SAGD"), comprising:

a single horizontal well in a heavy oil reservoir, an entire length of said horizontal well consisting essentially of blank tubulars and a plurality of passive inflow control devices ("ICDs"), each said ICD between blank tubulars, said horizontal well having a production segment at a heel end fitted for production, and an injection segment at a toe end fitted for steam injection, without vertical separation between said production segment and said injection segment, wherein said ICDs are more restrictive with a lower flow resistance rating in said injection segment than in said production segment.

19. The well configuration of claim 18, wherein a thermal packer separates said injection segment and said production segment.

20. The well configuration of claim 18, wherein said horizontal well further comprises active ICDs that can be controlled from said surface.

21. The well configuration of claim 18, wherein one or more blank pipes is placed between said injection segment and said production segment.

22. The well configuration of claim 21, wherein a thermal packer is placed in said blank pipe section to separate said injection segment and said production segment.

23. The well configuration of claim 21, wherein said production segment is 300-600 meters, said blank pipe is 12-50 meters and said injection segment is 150-250 meters.

24. An improved method of producing heavy oils from a single well steam and gravity drainage ("SW-SAGD"), wherein steam is injected into a toe end of a single horizontal well to mobilize oil which is then produced at a heel end of said horizontal well, the improvement comprising providing said horizontal well having an entire length consisting essentially of blank tubulars and a plurality of inflow control devices ("ICDs") that are more restrictive with a lower flow resistance rating in injector than in producer sections, thus improving a cumulative steam to oil ratio ("CSOR") of said horizontal well, as compared to a similar well with slots instead of said plurality of ICDs.

* * * * *